United States Patent [19]

Keefer

[11] Patent Number: 4,967,045

[45] Date of Patent: Oct. 30, 1990

[54] VERTICALLY-MOUNTABLE PIN SWITCH

[75] Inventor: Colin R. Keefer, Shavertown, Pa.

[73] Assignee: Harrison Electronic Systems, Inc., Wilkes Barre, Pa.

[21] Appl. No.: 459,477

[22] Filed: Jan. 2, 1990

[51] Int. Cl.[5] ..... H01H 13/14

[52] U.S. Cl. ..... 200/296; 200/61.62; 200/61.7; 200/61.76; 200/520; 200/341

[58] Field of Search ..... 200/61.62, 61.7, 61.73, 200/61.74, 61.76, 61.81, 61.82, 520, 341, 345, 296, 547

[56] References Cited

U.S. PATENT DOCUMENTS

| | | | |
|---|---|---|---|
| 1,125,948 | 1/1915 | Boyle | 200/61.73 |
| 2,499,958 | 3/1950 | Knowlton | 200/61.62 X |
| 2,662,969 | 12/1953 | Thompson | 200/61.7 |
| 3,251,971 | 5/1966 | Fraser | 200/61.62 |
| 4,599,498 | 7/1986 | Shimoya et al. | 200/61.76 X |
| 4,775,768 | 10/1988 | Kanbar | 200/345 |

FOREIGN PATENT DOCUMENTS

| | | | |
|---|---|---|---|
| 3320455 | 5/1984 | Fed. Rep. of Germany | 200/61.62 |
| 2131615 | 6/1984 | United Kingdom | 200/296 |

*Primary Examiner*—Ernest G. Cusick
*Attorney, Agent, or Firm*—Michael Ebert

[57] ABSTRACT

A normally-closed pin switch mountable on a vertical wall and adapted to open only when actuated by a movable closure member. The switch includes a metal bracket defined by a generally-rectangular mounting plate having mounting holes adjacent either end thereof and a ledge cantilevered from the upper edge of the plate at its midsection whereby the bracket may be secured to the vertical wall to position the ledge in a horizontal plane. Integral with the ledge and projecting therebelow is a hollow metal cylinder whose upper end registers with a port formed in the ledge and whose lower end acts as the fixed contact of the switch. Slidably received in the cylinder is a plunger rod of insulation material, the lower section of the rod extending through the lower end of the cylinder and terminating in a contact acting as the movable contact of the switch. The rod is spring-biased to normally urge the movable contact into engagement with the fixed contact to close the switch. The upper section of the rod projects above the port so that when pressed in by the movable closure member, the rod is then axially displaced to effect disengagement of the contacts and thereby open the switch.

6 Claims, 2 Drawing Sheets

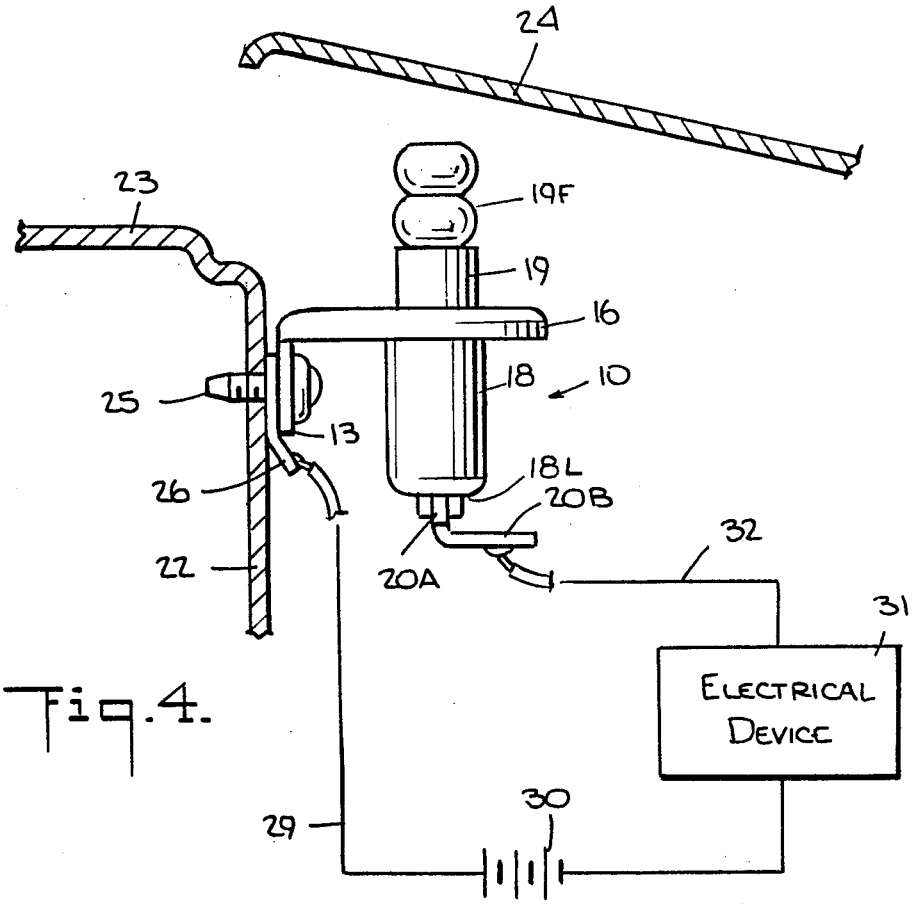
Fig. 4.
Fig. 5.
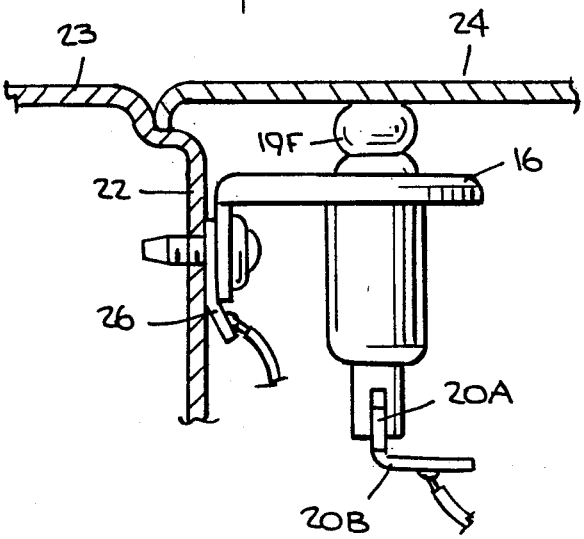
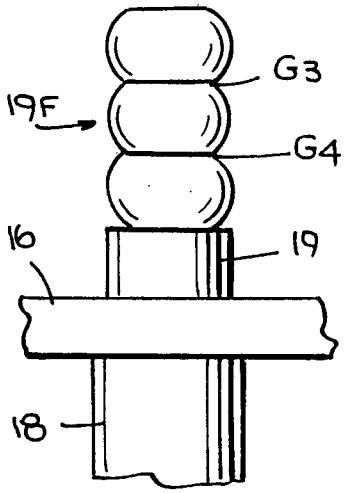
Fig. 6.

VERTICALLY-MOUNTABLE PIN SWITCH

BACKGROUND OF INVENTION

1. Field of Invention:

This invention relates generally to pin switches which are actuatable by a swingable door or other movable closure member to open a normally-closed electrical circuit, and more particularly to a universal switch of this type which can be tailored in length to meet the particular requirements of various installations and which can be vertically mounted.

2. Status of Prior Art:

The function of a pin switch is to break an electrical circuit when the switch comes into physical contact with a movable member at a predetermined position of this member, and to close the circuit when the member is shifted to another position. To carry out this function, the pin switch is provided with a pin or rod that when pressed in by the movable member effects disengagement of normally-closed switch contacts.

Pin switches are commonly used in refrigerators and electric ovens, the switch being so installed that when the hinged door of the refrigerator or oven is swung open to provide access to the interior, the switch then closes to complete a circuit to a lamp illuminating the interior. But when the door is thereafter shut, it then presses in the actuator pin of the switch, thereby opening the switch and turning off the light so that the interior of the refrigerator or oven is no longer illuminated.

Pin switches are also used in conjunction with automobile security systems to set off an alarm when the hood of the engine compartment or the lid of the trunk is forced open by an intruder. In a security installation, the system is put in its active mode by the owner before he leaves the vehicle, say, at a parking site. The pin switch is so placed in relation to the hinged trunk lid or engine compartment hood that the switch is in an open state when the trunk lid or hood is fully closed. But if the trunk lid or hood is thereafter forced open while the security system is in its active mode, the resultant closing of the pin switch triggers the security system to set off the alarm.

One practical problem encountered with pin switches is that each installation requires a pin length that puts the mounted pin switch in proper operative relation to the door, trunk lid or whatever other movable member is involved in the installation. If, therefore, one wishes to retrofit automobiles with a security system that requires a lid-actuated pin switch, the proper pin length depends on the trunk structure. And since this structure is not standardized for all cars and varies from model to model, the installer in order to cope with this situation must have available a large inventory of different pin switch sizes from which he can select the size appropriate to the installation being worked on.

Pin switches are commercially available in a range of pin lengths, and if the installer carries in inventory the full range of pin lengths, he will not be faced with a problem. But as is more often the case, the installer has a limited inventory of pin switches in different lengths, he may find that he lacks the particular length necessary to a given installation.

To meet the need for a universal pin switch that can be tailored to assume a proper pin length that satisfies a particular installation requirement, the patent to Kanbar, U.S. Pat. No. 4,775,768, whose entire disclosure is incorporated herein by reference, discloses a pin switch whose pin is in the form of an insulation rod having a front section in a corrugated formation to define a series of equi-spaced annular grooves, each marking an increment of rod length. In order to tailor the pin switch so that its effective length is appropriate to the requirements of a given installation, the user simply snips off the front section at the groove marking the desired length.

The practical difficulty with a Kanbar-type pin switch in which the switch is provided with a mounting plate at right angles to the pin is that it best lends itself to mounting on a horizontal brace or other horizontal surface in the trunk or engine compartment of an automobile. When so mounted, the insulation rod or pin then lies on a vertical axis so that it can be engaged by the hinged hood or trunk lid when it is closed.

However, the typical hinged hood in an automobile has a front edge that is somewhat curved; hence when the hood swings down to its fully closed position, the edge which then engages the pin of the switch travels in an arcuate path that is angled with respect to the vertical axis along which the pin is shiftable. As a consequence, the hood edge seeks to displace the switch pin from its vertical path and in doing so it may cause the pin switch to bend and break or malfunction.

Moreover, in many modern automobiles, absent in the engine compartment or in the trunk is a horizontal brace or other horizontal surface on which a Kanbar-type pin switch can be mounted. Hence this switch does not lend itself to installation in such a vehicle.

Because the mounting plate of the Kanbar-type pin switch is normal to the pin, when the switch is mounted on a vertical wall, the pin is then at right angles to the wall. For this reason, the Kanbar-type pin switch is not usable on a vehicle-mounted tool box, on step vans, repair trucks, enclosed trailers, recreational vehicles, mobile homes, and in other applications where a hinged door, lid or other closure meets a vertical wall at right angles thereto. If one were to mount a Kanbar-type switch on the vertical wall, its pin would be at right angles to this wall and would therefore not be engaged by the closure.

Of prior art interest are the U.S. patents to Kallage, Jr., et al., U.S. Pat. No. 3,821,529; Boosey, U.S. Pat. No. 1,112,760; King, Jr., U.S. Pat. No. 3,835,615; Fraser, U.S. Pat. No. 3,251,971, and the German patent No. 3,320,455 to Marten.

SUMMARY OF INVENTION

In view of the foregoing, the main object of this invention is to provide a normally-closed pin switch which is mountable on a vertical wall and is adapted to open an electrical circuit which is actuated by a movable closure member such as the lid of a trunk or the engine compartment hood of an automobile.

While the invention will be described in the context of a security system for an automobile, it is to be understood that it can be installed on any vertical wall which is so placed with respect to a movable closure member that the normally-closed switch is actuated and caused to open only when this member is shifted to and occupies its closed position.

More particularly, an object of the invention is to provide a pin switch of the above type which when secured to a vertical wall is stably mounted thereon to position the pin or plunger rod of the switch so that its axis is vertical and then parallel to the wall.

A significant advantage of the invention is that the pin switch may be so mounted on a vertical wall that the pin is then at an acute angle with respect to the vertical axis. Hence when this pin is engaged by the curved edge of a hood which in the course of closure travels at the same angle, there is then no tendency on the part of the edge to displace the pin from its proper path.

Also an object of this invention is to provide a pin switch having a pin that takes the form of a plunger rod of insulation material whose upper section is in a corrugated formation to define a series of equi-spaced annular grooves, each marking an increment of rod length, whereby in order to tailor the switch so that its effective rod length is appropriate to the requirements of a particular installation, the user simply snips off the upper section at the groove marking the desired length.

Briefly stated, these objects are attained in a normally-closed pin switch mountable on a vertical wall and adapted to open only when actuated by a movable closure member. The switch includes a metal bracket defined by a generally rectangular mounting plate having mounting holes adjacent either end thereof and a ledge cantilevered from the upper edge of the plate at its midsection whereby the bracket may be secured to the vertical wall to position the ledge in a horizontal plane.

Integral with the ledge and projecting therebelow is a hollow metal cylinder whose upper end registers with a port formed in the ledge and whose lower end acts as the fixed contact of the switch. Slidably received in the cylinder is a plunger rod of insulation material, the lower section of the rod extending through the lower end of the cylinder and terminating in a contact acting as the movable contact of the switch. The rod is spring-biased to normally urge the movable contact into engagement with the fixed contact to close the switch. The upper section of the rod projects above the port so that when pressed in by the movable closure member, the rod is then axially displaced to effect disengagement of the contacts and thereby open the switch.

BRIEF DESCRIPTION OF DRAWINGS

For a better understanding of the invention as well as other objects and further features thereof, reference is made to the following detailed description to be read in conjunction with the accompanying drawings, wherein:

FIG. 4 is a side view of the switch when installed on the vertical front wall of an engine compartment whose hood functions as a closure member, the switch being connected to the electrical device of a security system;

FIG. 5 shows the condition of the switch when it is actuated by the closed hood of the vehicle; and FIG. 6 shows the plunger rod of the switch after it has been snipped to reduce its length.

DESCRIPTION OF INVENTION

Figure 1:
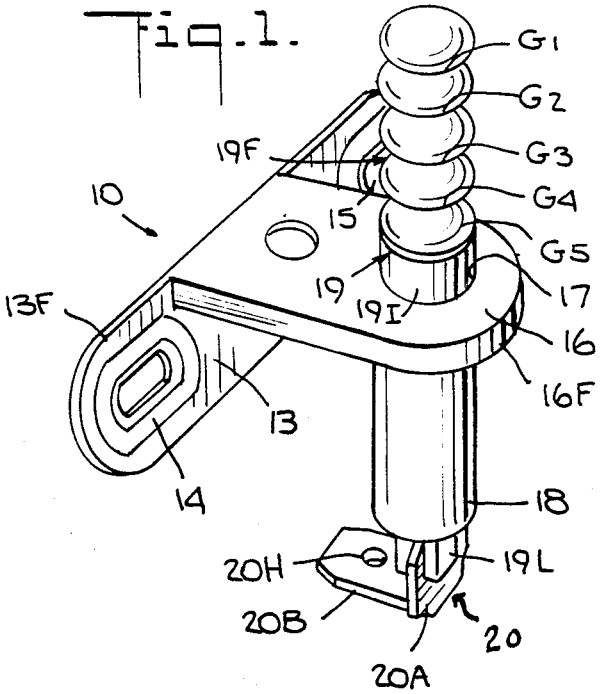
FIG. 1 is a perspective view of a pin switch in accordance with the invention.
Figure 2:
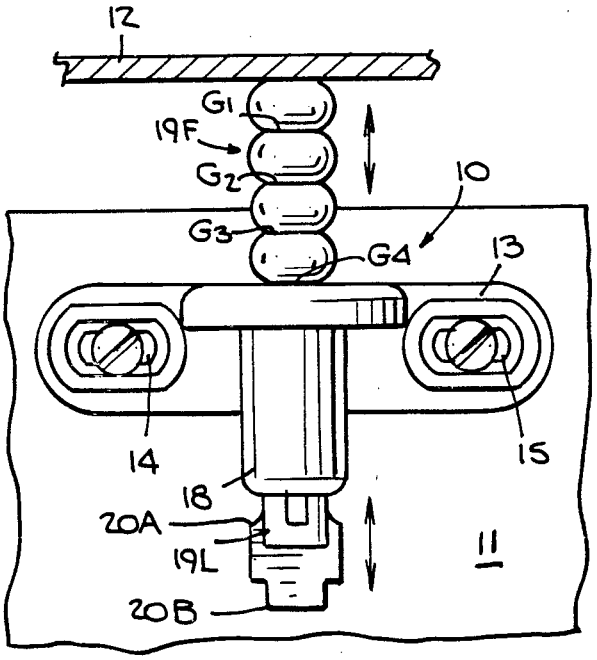
FIG. 2 is a front view of the switch in its open state showing it in relation to a vertical wall on which it is to be mounted and a movable closure member which actuates the switch.
Figure 3:
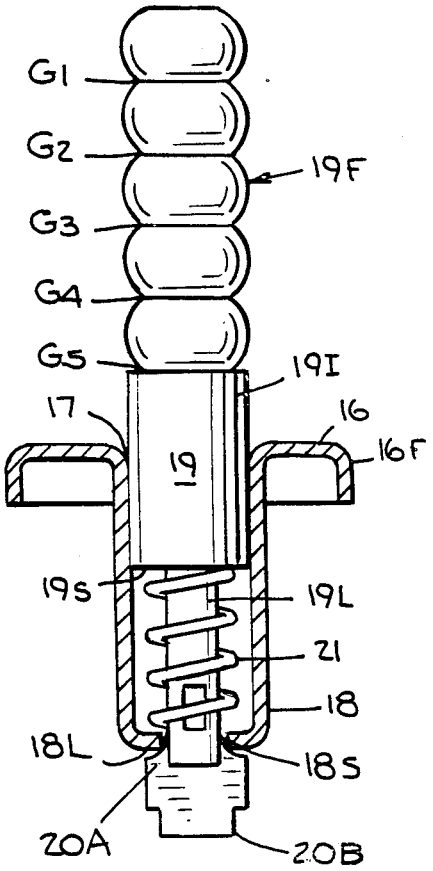
FIG. 3 is a section taken through the switch in its normally closed state.

Switch Structure:

Referring now to FIGS. 1 to 3, there is shown the structure of a normally-closed pin switch in accordance with the invention, generally designated by numeral 10. The switch is mountable on a vertical wall 11 and is adapted to open only when actuated by a movable closure member 12 in its closed position. The member may be a hinged door, an automobile trunk lid, the hood of an engine compartment, or any other movable or swingable member which when closed causes the switch to open to break an electrical circuit.

Switch 10 includes a metal bracket formed of electrically-conductive, non-corrosive material of high strength such as nickel-plated steel. The bracket is defined by a generally rectangular mounting plate 13 having rounded ends and oblong mounting holes 14 and 15 adjacent either end of the plate to receive rivets or bolts to secure the plate against a vertical wall. Cantilevered is a ledge 16. The ledge and plate 13 have continuous peripheral inwardly-turned flanges 16F and 13F which act to resist bending of the plate and bending of the ledge relative to the plate.

At the center of metal ledge 16 is a circular opening or port 17, and integral with the ledge and projecting therebelow is a hollow metal cylinder 18 whose upper end merges and registers with the port, the longitudinal axis of the cylinder being parallel to the plane of mounting plate 13.

Slidably received in metal cylinder 18 is a solid plunger rod 19 of high-strength insulation material, the diameter of the cylindrical intermediate section 19I of the rod substantially matching the inner diameter of the cylinder so that it is freely slidable therein. The lower section 19L of rod 19 is of reduced thickness to define a shoulder 19S at the junction of this section and the intermediate section 19I of the rod. Lower section 19L, which has a rectangular cross section, extends through a matching slot 18S in the dome-shaped lower end 18L of cylinder 18.

Lower section 19L terminates in an L-shaped metal lug 20, preferably fabricated of a tinplated brass or other highly conduct contact material. One leg 20A of lug 20 is embedded in the end of lower section 19L of the rod and acts as the movable contact of the switch. The other leg 20B has a hole 20H therein to receive a wire to be soldered to this leg which serves as the terminal for the movable contact.

A helical compression spring 21 is housed within cylinder 18 and surrounds the lower section 19L of the plunger rod. The spring is compressed between the shoulder 19S of the rod and the lower end 18L of cylinder 18 which functions as the fixed contact of the switch. Spring 21 acts to urge movable contact 20 into engagement with fixed contact 18L so that the switch is normally closed.

The cylindrical upper section 19F of the rod extends upwardly from port 17 and functions as the actuator pin of the switch. This section is in a corrugated formation defined by a series of equi-spaced grooves $G_1$ to $G_5$, each marking an exact increment of length.

Rod 19 is fabricated of a rigid and somewhat brittle plastic dielectric material such as PVC or polycarbonate. The physical characteristics of the rod are such that when any of the annular grooves $G_l$ to $G_5$ of the upper section 19F is engaged by a standard manual wire cutter and the cutter then operated, the upper section is neatly severed at this point and the end of the upper section which remains is smooth and flat to afford an actuating head. Thus FIG. 6 shows the switch after the upper section 19F has been severed at groove $G_2$, thereby shortening the length of the rod by two increments.

The length of upper section 19F of the rod must be appropriate to the switch installation, for in some cases, the full length of the section is required, while in other cases a lesser length is called for. Since each annular groove $G_1$ to $G_5$ represents an increment of the full length, the installer has only to snip off a portion of the front section providing the desired lesser length. Thus the pin switch is a universal switch in that it can be tailored to any desired length within the limits of its range.

When closure member 12 engages and presses down the head of upper section 19F rod 19, as shown in FIG. 2, this rod is axially displaced to further extend the lower section 19L of the rod beyond the contact end 18L of the metal cylinder and thereby disengage the movable contact 20A from fixed contact 18L to open the switch.

Installation:

As shown in FIGS. 4 and 5, a pin switch 10 in accordance with the invention lends itself to installation on the front vertical wall 22 of the engine compartment of an automobile, having a fender 23 which overlies a wheel well and is joined to the upper edge of the vertical wall. The vehicle is also provided with a hood 24 which when pulled down encloses the engine compartment.

Pin switch 10 is mounted on vertical wall 22 by means of rivets 25 or similar fasteners which go into the mounting holes 14 and 15 on plate 13 of the bracket. The mounting is such as to position the actuator rod or pin of the switch along a vertical axis. Because the mounting holes of the bracket are on either side of the ledge 16 on which the pin switch is symmetrically supported, the switch is stably and firmly anchored on the vertical wall.

Interposed between mounting plate 13 of the bracket and wall 22 is a metal lug 26 which is connected through the metal bracket to the metal cylinder 18 and therefore acts as the terminal for the fixed contact 18L at the lower end of the cylinder. Lug 26 is connected by a wire 29 soldered thereto to one pole of a DC power supply 30 whose other pole is connected to one end of an electrical security device 31 whose other end is connected through a wire 32 soldered to the arm 20B of the lug. The other arm 20A of this lug forms the movable contact of the switch.

When, as shown in FIG. 5, hood 24 is closed, it physically engages the head of upper section 19F of the rod of the pin switch, to displace the rod axially and thereby open the switch. When hood 24 is closed and the switch is then open, the security system represented by device 31 is then disabled. But when hood 24 is raised by an intruder, seeking access to the engine so as to start the car or for any other unauthorized purpose, then, as shown in FIG. 4, the pin switch rod returns to its normal position and the switch is closed to activate the alarm.

In the arrangement shown, the length of section 19F of the rod has been shortened so that its length is appropriate to the position of the switch relative to the hood. A similar arrangement may be used in the trunk of the vehicle or elsewhere therein.

While there has been shown and described a preferred embodiment of a vertically-mounted pin switch in accordance with the invention, it will be appreciated that many changes and modifications may be made therein without, however, departing from the essential spirit thereof.

I claim:

1. A normally-closed pin switch mountable on a vertical wall and adapted to open only when actuated by a movable closure member such as a door or automobile hood, said switch comprising:

(a) a conductive metal bracket formed by a generally rectangular mounting plate and a ledge cantilevered from an upper edge of the plate at a midsection of said upper edge, said ledge having a port therein and being in a horizontal plane when the bracket is mounted on the wall, said mounting plate and said ledge being each provided with a continuous peripheral flange to resist bending forces;

(b) a hollow conductive metal cylinder integral with the ledge and extending at right angles thereto, said cylinder having an upper end and a lower end, the upper end of the cylinder registering with the port, the lower end of the cylinder being partially closed to define a fixed contact having a slot therein; and (c) a plunger rod of insulation material received in the cylinder, said rod having a cylindrical intermediate section whose diameter substantially matches the inner diameter of the cylinder whereby the rod is freely slidable therein, a lower section that extends through the slot and terminates in a movable contact, and an upper section extending above the port and terminating in a head which when engaged and pressed down by the closure member causes axial displacement of said rod to effect disengagement of the contacts to open the switch; and (d) a spring housed in the cylinder that normally urges the movable contact into engagement with the fixed contact to close the switch.

2. A pin switch as set forth in claim 1, wherein said rod is formed of polycarbonate material.

3. A pin switch as set forth in claim 1, wherein said plate is provided with mounting holes positioned symmetrically on either side of the ledge.

4. A pin switch as set forth in claim 1, wherein said lower section is of reduced thickness relative to the intermediate section and has a rectangular cross section, said slot having a matching cross section.

5. A pin switch as set forth in claim 4, in which the spring is a helical spring surrounding the lower section of the rod and is compressed between a shoulder formed at a junction of the intermediate and lower section and the partially closed lower end of the cylinder.

6. A pin switch as set forth in claim 1, wherein said upper section has a corrugated formation defined by a series of annular grooves each marking an increment of length whereby the length of the upper section can be shortened by severing the section at a selected groove.

* * * * *